US005087044A

United States Patent [19]

Okushima

[11] Patent Number: 5,087,044

[45] Date of Patent: Feb. 11, 1992

[54] MARKING MEMBER STORAGE DEVICE FOR GOLF CLUB

[76] Inventor: Kaoru Okushima, 1-21-17 Andou, Shizuoka, 420, Japan

[21] Appl. No.: 633,942

[22] Filed: Dec. 26, 1990

[51] Int. Cl.[5] ..... A63B 57/00; A63B 53/14

[52] U.S. Cl. ..... 273/162 D; 273/194 R

[58] Field of Search ..... 273/162 R, 162 D, 162 E, 273/162 F, 194 R, 194 A, 194 B, 186 A, 32 A

[56] References Cited

U.S. PATENT DOCUMENTS 1,756,141 4/1930 Spellmeyer ..... 273/162 D 4,239,216 12/1980 Bauer ..... 273/162 D

*Primary Examiner*—George J. Marlo

*Attorney, Agent, or Firm*—Kanesaka and Takeuchi

[57] ABSTRACT

A device for storing marking members in a golf club, in particular a putter. The device includes a recess formed in the upper end surface of the club capable of receiving a marking member. When the marking member is lightly pressed, a marking member holder is allowed to spring out so as to allow the marking member to be detached from the marking member holder. When the marking member is not used, the marking member holder is pressed into the recess so as not to impede the play. The marking member is securely held in the end of the golf club, thus eliminating any risk of missing of the marking member.

7 Claims, 5 Drawing Sheets

MARKING MEMBER STORAGE DEVICE FOR GOLF CLUB

BACKGROUND OF THE INVENTION

1. Field of the Invention

The present invention relates to a device which enables an easy storage on a golf club of a marking member which marks the position of a ball on the green of a golf link.

2. Description of the Prior Art

When a hit golf ball is stationed on the green of a golf link, the player picks up the ball so that it may not hinder putt of other players. In order to mark the position of the ball, the player places a coin-like small chip as shown in FIGS. 8 and 9, generally referred to as a marking member 25, in place of the picked up ball, thus facilitating recognition of the position of the ball.

This work has to be conducted for each hole of the play, so that the player is obliged to keep a plurality of marking members in his pocket or, alternatively, legs 26 of making members 25 having a shape as shown in FIG. 9 are inserted to a retaining hole 28 provided on the upper end of the grip 27of a butter. Anyway, the player has to pickup one of the marking members out of his pocket or from the retaining hole 28 each time the use of such a marking member becomes necessary.

The marking member stored in the pocket of the player is generally small so that it is liable to be lost during repeated use and storage in the pocket.

The marking member of the type shown in FIG. 9 also tends to be lost because it easily comes off the retainer hole when impacted during handling of the putter or storage in a bag.

SUMMARY OF THE INVENTION

Accordingly, an object of the present invention is to provide a device for storing marking members on a golf club, particularly a putter, the device including a recess formed in an upper end of the putter for accommodating the marking member in such a way as to allow the marking member to spring out by a single operation and that the marking member is held stably when it is not necessary to use the marking member, thereby overcoming the above-described problem of the known art.

To this end, according to the present invention, there is provided a device for storing a marking member in a golf club, comprising: a grip of a golf club; a main member mounted in a mounting hole formed in the end of the grip, the main member being provided with a recess formed in the outer end thereof; a movable member received in the main member so as to be moved outward to project from the bottom of the recess and be pushed inward into the main member; a marking member holder provided on an end of the movable member and adapted to detachably hold the marking member; fixing means for fixing the marking member holder in such a state that the marking member is received in the recess; and releasing means for releasing the fixing operation of the fixing means so as to allow the movable member to project outward from the recess.

The device of the present invention for storing marking members on a golf club includes a holder provided in the end of the grip of a golf club and adapted to detachably hold the marking members. The marking members are securely held on the holder in the grip when they are not used. Consequently, the marking members are handled with ease and without being lost during handling or storage of the golf club.

DESCRIPTION OF THE PREFERRED EMBODIMENTS

Preferred embodiments of the device in accordance with the present invention will be described with reference to the accompanying drawings.

Figure 1:
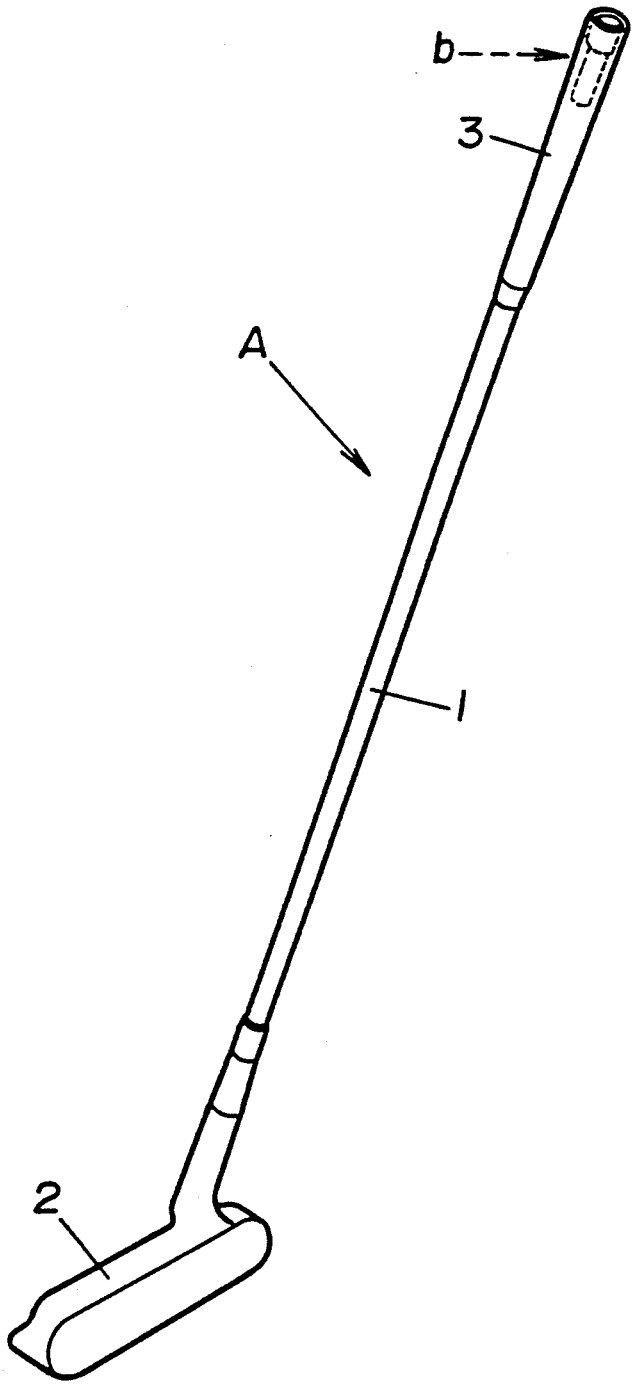
FIG. 1 is a perspective view of a golf club incorporating a device in accordance with the present invention.
Figure 3:
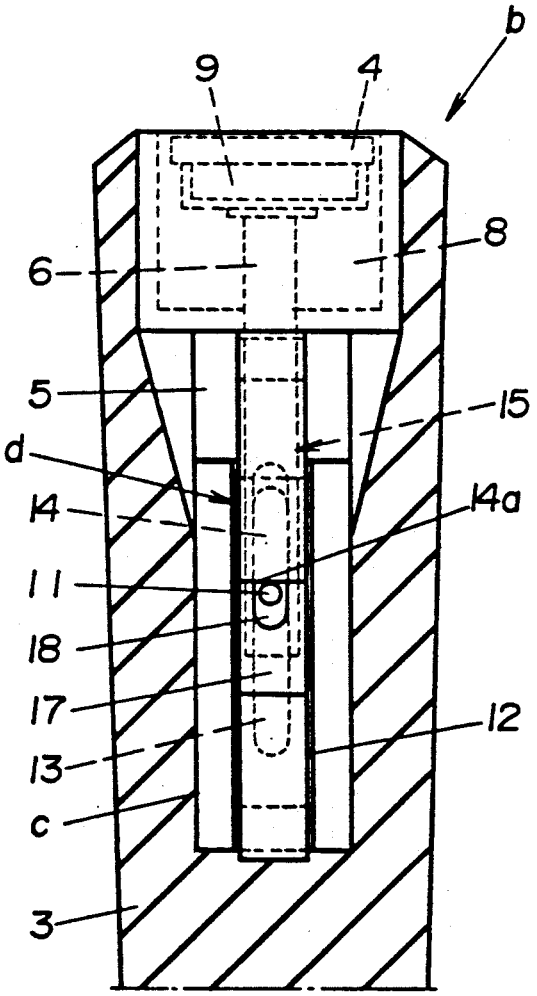
FIG. 3 is a longitudinal sectional view of the device shown in FIG. 2.
Figure 2:
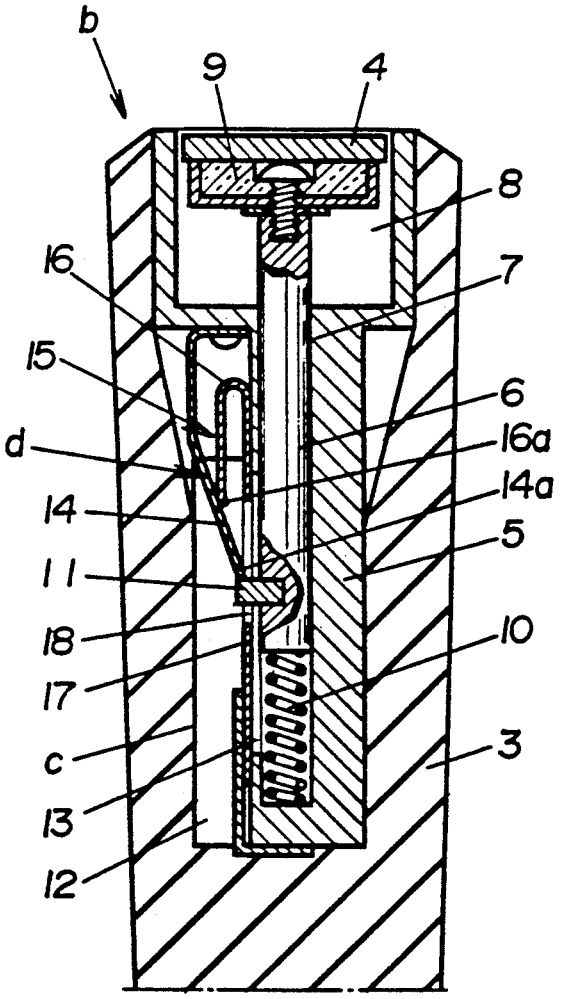
FIG. 2 is an embodiment of the device in accordance with the present invention.

Referring to FIG. 1, a golf club, particularly a putter which is used for putting on a green, is represented by a mark A. The putter A has a shaft 1 of a predetermined length and a head 2 provided on one end of the shaft 1. A grip 3 of a size suitable for gripping by hands is formed on the opposite end of the shaft 1 to the head 2.

The club A is not limited to a putter and the device of the present invention may be provided on a club of a different type, although the device is most suitably used in combination with a putter which is used on a green where the use of the marking member is often necessary.

A symbol b represents a device for storing a marking member 4 in the grip 3. This device is so constructed that the marking member 4, held on a holder, is jumped off a later-mentioned recess or moved into the recess simply by being pushed axially.

The device b has a cylindrical main member 5 which is received in a mounting hole c formed in the grip 3 and a bore 7 is formed in the center of the main member 5 for movably receiving a moving member 6. The outer end of the main member 5 is flush with the outer end surface of the grip 3. A recess 8 is formed in the end of the grip 3 which opens so as to receive a marking member 4.

The movable member 6 is axially inserted into the bore 7 in the main member 5 and is provided at its one end with a marking member holder 9 such as a magnet. The holder 9 is received in the recess 8 so as to be moved into and out of the recess 8. A coiled spring 10 is loaded between the inner end of the movable member 6 and the bottom of the bore 7 so that the movable member 6 is normally biased outward, such that the marking member holder 9 is spring out through the recess 8.

The marking member 4 is used to enable re-locating of a ball after the ball on a green is picked up. The marking member 4 is sized so that it may be received in the recess 8 and has, for example, a disk-like form. The marking member 4 is made of a magnetic material such as a metal so as to be attracted and held by the marking member holder 9. Patterns and characters may be placed on the surface of the marking member 4.

Although a marking member 4 made of a magnetic material such as a metal is attracted and held by the marking member holder 9 in the illustrated embodiment, this is only illustrative and the arrangement may be such that both the marking member 4 and the marking member holder 9 are provided with planar fastener (not shown) so that the marking member 4 may easily be attached to and detached from the marking member holder 9.

Figure 5:
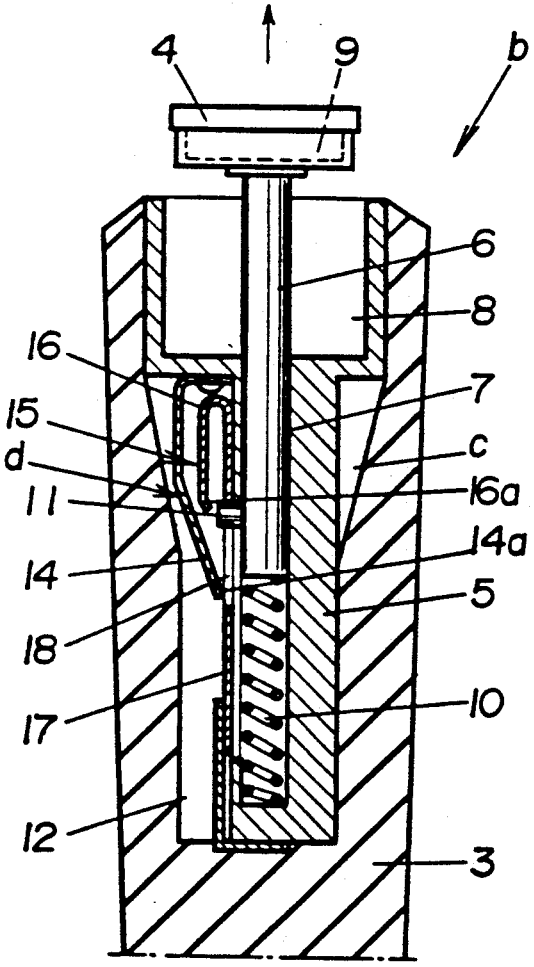
FIG. 5 is a longitudinal sectional view of the embodiment shown in FIG. 2 in a state in which a marking member has been projected outside the club.
Figure 7:
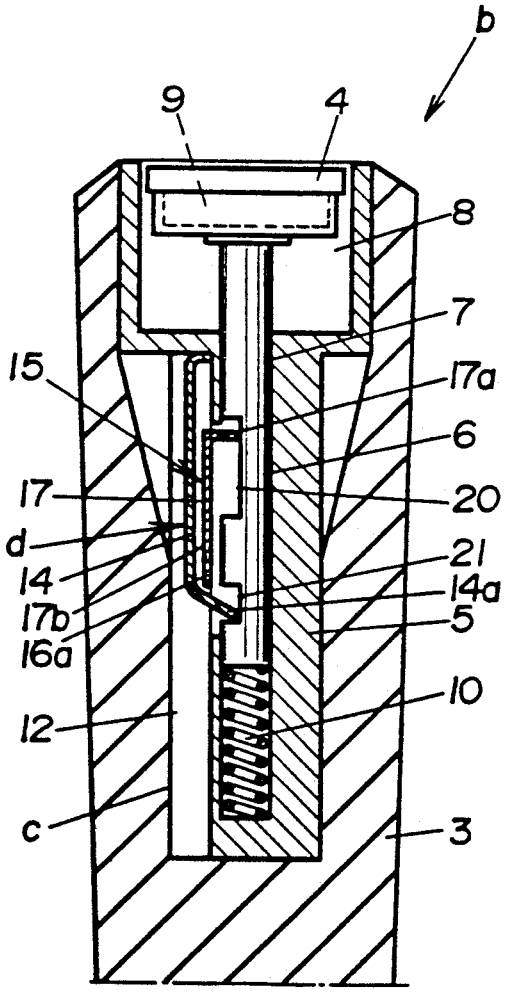
FIG. 7 is a longitudinal sectional view of a critical portion of a third embodiment of the present invention.
Figure 6:
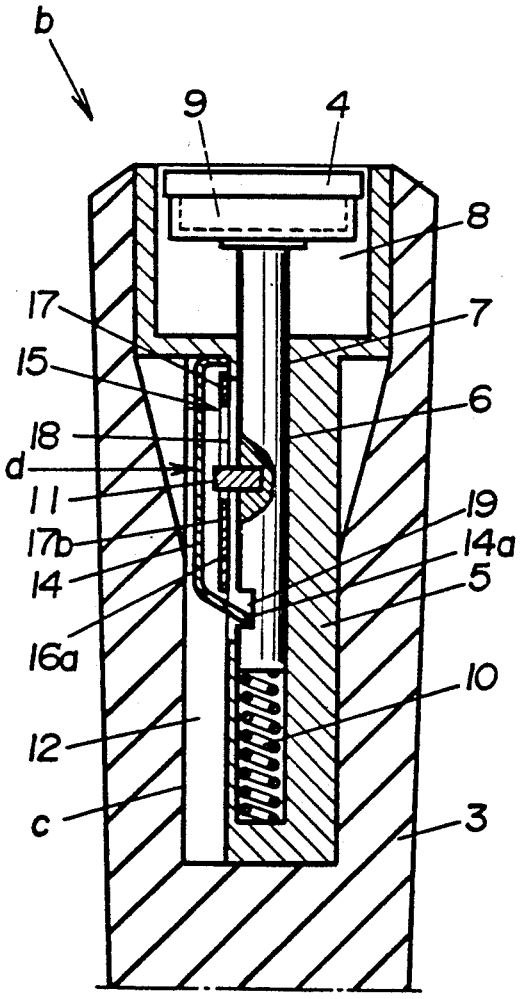
FIG. 6 is a longitudinal sectional view of the embodiment shown in FIG. 1 in a state in which a marking member is pushed into a club.
Figure 8:
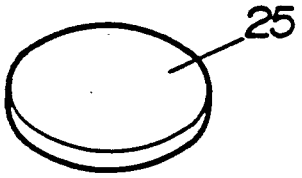
FIG. 8 is an illustration of a marking member conventionally used in golf.
Figure 9:
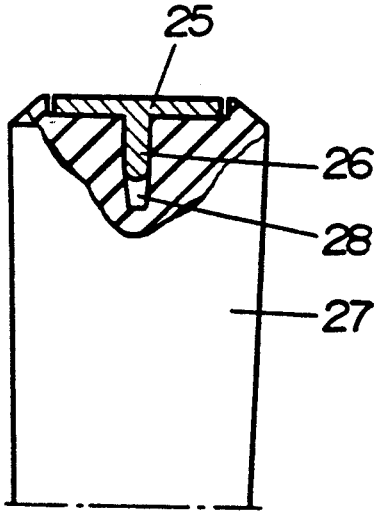
FIG. 9 is a longitudinal sectional view showing the manner in which the marking member of FIG. 8 is attached.

Referring to FIGS. 2 to 7, a symbol d represents a fixing means for fixing the movable member 6. A first type of the fixing means d is shown in FIGS. 2 to 5, while FIGS. 6 and 7 show a second type.

Referring first to FIGS. 2 to 5, numeral 11 denotes a stopper pin which projects from the outer peripheral surface of the movable member 6 and which engages with an elongated slot 13 formed in a notch 12 of a wall of the main member 5.

The fixing means has a resilient tab 14 in the form of a leaf spring which extends in parallel with the elongated slot 13 so as to partially cover the latter. The resilient tab 14 is secured to the notch 12 such that the resilient tab 14 is resiliently loaded. When the pin 11 passes a space under the resilient tab 14 so as to bring a stopper portion 14a on the end of the resilient tab 14 into engagement with the stopper pin 11, the marking member holder 9 is received in the recess 8 such that the marking member 4 is slightly recessed from the end surface of the grip 3, so as not to cause any impediment on the play. In this state, the stopper pin 11 resiliently contacts with the stopper portion **14*a* of the resilient tab 14 by the force of the spring 10**.

The second example of the fixing means d also employs a leaf-spring-shaped resilient tab 14 which extends in parallel with the elongated slot 13 in the main member 5 and which partially covers the elongated slot 13, as in the case of the first example. The resilient tab 14 is fixed at its one end to the main member 5 while the stopper portion **14*a* on the other end engages with a retainer groove 21 formed in the movable member 6, whereby the marking member holder 9 is received in the recess 8**.

Numeral 15 designates releasing means for releasing the fixing means d. Three types of the releasing means are conceivable: namely, a first type shown in FIGS. 2 to 5, second type shown in FIG. 2 and third type shown in FIG. 7.

The first type employs a tabular slider 17 having a manipulation portion **16*a* on a bent upper end 16 thereof. The slider 17 is slidably received in the notch 12. The slider 17 movably engages with the notch 12 and is provided at its intermediate portion with a retaining hole 18 of substantially the same position and size as the elongated slot 13. The stopper pin 11 engages with this retaining hole 18**.

When the marking member holder 9 is pushed so as to displace the movable member 6 inwardly, the slider 17 engaging with the stopper pin 11 is pushed by the pin 11 so as to move inward together with the movable member 6, so that the bend tab 16 provided on the slider 17 acts to expand the resilient tab 14 outward, thus keeping a clearance large enough to permit the passage of the stopper pin 11.

As the pressing force on the marking member holder 9 is dismissed in this state, the movable member 6 is pushed outward by the force of the spring 10 so as to cause the marking member holder 9 to project from the recess 8. At the same time, the stopper pin 11 of the movable member 6 engages with the upper edge of the retaining hole 18 in the slider so as to cause the slider 17 to be lifted accompanying the movement of the movable member 6. Consequently, the bent tab 16 is disengaged from the inside of the resilient tab 13 and is brought again into engagement with the notch 12.

The second type of the releasing means 15 has a stopper pin 11 projected from the outer peripheral surface of the movable member 6 and a tabular slider 17 movably engaging in the notch 12 mentioned before. The stopper pin 11 engages with a retaining hole 18 formed in the slider 17. The resilient tab 14 has an end engaging with a retaining groove 19 which is formed in a portion of the movable member beneath the stopper pin 11. The arrangement may be such that, when the making member holder 9 is pressed to cause the movable member 6 to move inward, the slider 17 engaging with the stopper pin 11 is pushed by the stopper pin 11 so as to move inward together with the movable member 6. Consequently, the end of the slider 17 expands the resilient tab 14 outwards so that the resilient tab 14 is disengaged from the retaining groove 19. As the pressing force on the marking member holder 9 is dismissed in this state, the slider 17 is stationed in this position so that the retaining groove 17 is concealed by the shield portion **17*b* of the slider 17 so as to prevent the stopper portion 14*a* of the resilient tab 14 from engaging with the retaining groove 19. As a result, the movable member 6 is pushed outward by the force of the spring 10, whereby the marking member holder 9 projects from the recess 8**.

The third type of releasing means 15 has a flat tabular slider 17 movably received in the notch 12. A hook-shaped bent portion **17*a* on the upper end of the slider 17 is loosely received in a movement groove 20 formed in the outer peripheral surface of the moving member 6. The lower end is opened to provide a manipulating portion 16a. The resilient tab 14 of the releasing means d has stopping portion 14*a* on one end thereof; the stopping portion 14*a* engaging with a retaining groove 21 formed in a portion of the movable member 6 beneath the movement groove 20. The arrangement is such that, when the marking member holder 9 is pushed to move the movable member 6 inward, the slider 17 is pushed by the movement groove 20 so as to move inward together with the movable member 6, so that the end of the slider 17 expands the resilient tab 14 outward, so that the resilient member 14 is disengaged from the retaining groove 21. As the pressing force exerted on the marking member holder 9 is dismissed in this state, the slider 17 is stationed at the instant position, so that the retaining groove 21 is concealed by the shield portion 17*b* of the slider 17, so as to prevent the stopper portion 14*a* of the resilient tab 14 from engaging with the retaining groove 21. As a result, the movable member 6 is forced outward by the force of the spring 10 so that the mark holder 9 projects from the recess 8**.

In the second and third types of the releasing means 15, the slider 17 has a tabular form with a small thickness, so that the mounting hole c in the grip 3 can have a minimal size.

The device of the present invention for storing a marking member on a golf club has the constructions explained hereinbefore. The operation of the device will now be described mainly with reference to the first embodiment.

The marking member 4 is designed to be held by the marking member holder 9. In the first embodiment, the marking mebmer holder 9 is a magnet so that the marking member 4 is made of a magnetic material.

When the marking member holder 9 is received in the recess 8 of the main member 5 received in teh grip 3, the stopper pin 11 projecting from the mvoable member 6 is held in engagement with the resilient tab 14 by the force of the spring 10 so as to be prevented from movign outward. Therefore, the marking member 4 is held by the marking member holder 9 such that the upper end of the marking member 4 does not project beyond the upper edge of the recess 8. (see FIGS. 1 o 3)

Figure 4:
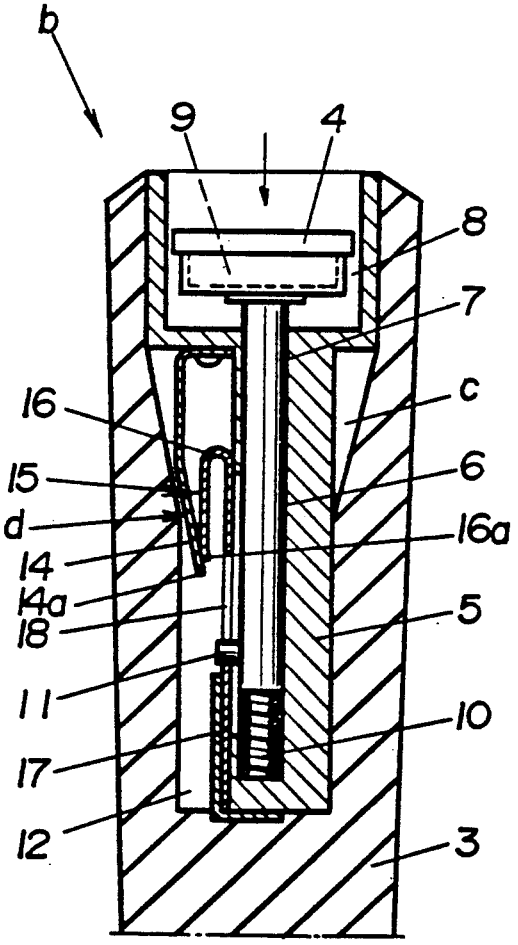
FIG. 4 is a longitudinal sectional view of a critical portion of the second embodiment of the present invention.

When the marking member holder 9 is pressed inward by a finger at the top end of the storage device b, i.e., within the recess 8 of the main member 5 fitting in the grip 3, the movable member 6 of the marking member holder 9 is moved downward against the force of the spring 10 as illustrated in FIG. 4.

Simultaneously, the releasing means 15 of the resilient tab 14, drivingly associated with the movable member 6, is pushed to be relieved outward. As the finger pressure exerted on the marking member holder 9 is dismissed, the spring 10 presses the movable member 6 outward so that the marking member holder 9 projects from the recess 8 as shown in FIG. 5. Consequently, the marking member holder 9 can easily be demounted for use, as illustrated by an imaginary line.

When the marking member 4 is to be stored, the marking member 4 is attached to the marking member holder 9 as shown in FIG. 5 and the marking member holder 9 is pushed again into the recess 8. Consequently, the movable member 6 is moved downward against the force of the spring 10 so as to cause the stopper pin 11 of the movable member 6 to be engaged and retained by the resilient tab 14. In consequence, the marking member holder 9 is received in the recess 8 below the level of the upper edge of the recess 8, so that the marking member 4 held by the marking member holder 9 does not impede the use of the club.

The slider 17 in the releasing means may be freely received in the movement groove 6 formed in the movable member 6, as shown in FIG. 7. The resilient tab 14 may engage the retaining groove 19 or 21 formed in the movable member 6 as shown in FIGS. 6 and 7.

The device b of the present invention may be attached to the grip of an existing club A or may be provided in the golf club in the course of the manufacture of the golf club. It is also possible to mount the device b in the grip 3 and to attach the grip 3 to an existing golf club A.

What is claimed is:

1. A device for storing a marking member in a golf club, comprising:

a grip for a golf club;

a main member mounted in a mounting hole formed in the end of said grip, said main member being provided with a recess formed in the outer end thereof;

a movable member received in said main member so as to be movable outward to project from the bottom of said recess and be pushed inward into said main member;

a marking member holder provided on an end of said movable member and adapted to detachably hold said marking member;

fixing means for fixing said marking member holder in such a state that said marking member is releasably held in said recess; and releasing means for releasing the fixing operation of said fixing means so as to allow said movable member and marking member holder to project outward from said recess.

2. A device according to claim 1, wherein said fixing means includes a stopper pin provided on the outer peripheral surface of said movable member, and a resilient tab having one end fixed to said main member with a stopper portion of the other end held in contact with said pin, so as to hold said marking member holder within said recess.

3. A device according to claim 1, wherein said fixing means includes a resilient tab having one end fixed to said main member and provided on the other end with a stopper portion engaging with a retaining groove in said movable member so as to prevent said movable member from moving, thereby keeping said marking member holder within said recess.

4. A device according to claim 1, wherein said releasing means includes an elongated slot formed in said main member, a stopper pin projecting from the periphery of said movable member, a slider slidably engaging with said elongated slot and having a retaining hole engaging with said stopper pin, and an operating portion annexed to said slider and operatively associated with said stopper pin so as to relieve said fixing means outward when said movable member is moved inward and outward.

5. A device according to claim 1, wherein said releasing means includes an elongated slot formed in said main member, a movement groove formed in the peripheral wall of said movable member, a slider having one end loosely received in said movement groove, an operating portion provided on the other end of said slider and adapted to be pressed by said movement groove so as to relieve said fixing means outward when said movable member is moved inward, and a shield portion for preventing said fixing means from engaging with said retaining groove when said moving member is moved outward.

6. A device for storing a marking member in a golf club, comprising:

a shaft for a club;

a club head provided on one end of said shaft;

a grip provided on the other end of said club shaft;

a main member mounted in a mounting hole formed in the end of said grip, said main member being provided with a recess formed in the outer end thereof;

a movable member received in said main member so as to be movable outward to project from the bottom of said recess and be pushed inward into said main member;

a marking member holder provided on an end of said movable member and adapted to detachably hold said marking member;

fixing means for fixing said marking member holder in such a state that said marking member is releasably held in said recess; and releasing means for releasing the fixing operation of said fixing means so as to allow said movable member and marking member holder to project outward from said recess.

7. A golf club including a device for storing a marking member comprising:

a shaft for a club;

a club head provided on one end of said shaft;

a grip provided on the other end of said club shaft;

a main member mounted in a mounting hole formed in the end of said grip, said main member being provided with a recess formed in the outer end thereof, said recess being adapted for receiving a marking member;

a movable member received in said main member so as to be movable outward to project from the bottom of said recess and be pushed inward into said main member, said movable member being biased outward by a spring associated with the inner end thereof;

a marking member holder provided on an end of said movable member and adapted to detachably hold said marking member;

a movement groove provided in the periphery of said movable member;

a retaining groove provided in a portion of the periphery of said movable member beneath said movement groove;

a resilient tab having one end fixed to said main member and provided at the other end with a stopper portion engaging with said retaining groove so as to prevent movement of said movable member thereby keeping said marking member holder within said recess;

a slider having an inwardly bent end loosely received in said movement groove;

an operating portion provided on the lower end of said slider and operatively associated with said movement groove so as to outwardly push said resilient tab when said movable member is moved inward; and a shield portion provided on said slider and adapted to cover said retaining groove in said movable member so as to prevent said resilient tab from engaging with said retaining groove, when said movable member is moved outward.

* * * * *